US005765382A

United States Patent [19]

Manning et al.

[11] Patent Number: 5,765,382

[45] Date of Patent: Jun. 16, 1998

[54] ADAPTIVE DEFROST SYSTEM

[75] Inventors: William R. Manning, North Attleboro; Richard J. Lisauskas, Wrentham, both of Mass.; Thomas E. Suita, Warwick, R.I.; Thomas W. Sun, Los Angeles, Calif.

[73] Assignee: Texas Instruments Incorporated, Dallas, Tex.

[21] Appl. No.: 705,489

[22] Filed: Aug. 29, 1996

[51] Int. Cl.[6] ..... F25B 47/02

[52] U.S. Cl. ..... 62/154; 62/155; 62/156

[58] Field of Search ..... 62/154, 151, 155, 62/156, 234, 230, 80, 81

[56] References Cited

U.S. PATENT DOCUMENTS

| | | | |
|---|---|---|---|
| 4,481,785 | 11/1984 | Tershak et al. . | |
| 4,528,821 | 7/1985 | Tershak et al. . | |
| 4,750,332 | 6/1988 | Jenski et al. . | |
| 4,850,204 | 7/1989 | Bos et al. . | |
| 4,884,414 | 12/1989 | Bos et al. . | |
| 5,295,361 | 3/1994 | Novak et al. | 62/155 X |
| 5,363,669 | 11/1994 | Janke et al. . | |
| 5,369,962 | 12/1994 | Szynal et al. | 62/155 X |
| 5,440,893 | 8/1995 | Davis et al. | 62/234 X |

*Primary Examiner*—Harry B. Tanner
*Attorney, Agent, or Firm*—Russell E. Baumann; Richard L. Donaldson; Gené E. Grossman

[57] ABSTRACT

An adaptive defrost control for a refrigerator is shown in which a single linear power supply (12) and microprocessor (U1) is used for both the adaptive defrost and cold control functions. According to a feature of the invention, a zero current crossing point switching scheme may be used to improve relay cycle life. According to another feature, a calibration procedure based on line frequency may be used to obtain multiples of a selected unit of time for any accumulated compressor run time and defrost heater energization times. According to another feature a sample and hold technique may be used to distinguish between noise and valid signals. In a modified embodiment, a toroid (40) has a primary connected to a common line leading to the compressor motor (24) and defrost heater (26) to provide a signal (ST) which, when taken with the state of relay contacts in respective lines energizing the compressor motor and defrost heater, as determined by the microprocessor, results in monitoring the compressor and defrost heater energization time. In another embodiment, a motor start control incorporating a PTC element (28) is combined with the adaptive defrost control. A double pole, single throw relay (K4) initiates both the compressor motor starting and refrigerator heater functions and open circuits the PTC element after starting has been completed in order to conserve power. In a modified embodiment the latter relay (K4) is used to start the compressor motor without the PTC element (28).

17 Claims, 13 Drawing Sheets

ADAPTIVE DEFROST SYSTEM

BACKGROUND OF THE INVENTION

This invention relates generally to defrost controls for refrigerators and more particularly to a system utilizing electronic controls to provide defrost operation which is continuously adjusted to maximize efficiency.

So-called adaptive defrost systems are known in which the length of time the defrost heater is energized is based on previous cycle history including the length of previous accumulated compressor run times. Such systems provide more cost efficient operation compared to conventional mechanical timers which provide a fixed time interval for initiating the defrost operation regardless of changes in need.

Conventional adaptive defrost controls utilize a microprocessor in determining the accumulated run time of the compressor in a given compressor-defrost cycle through the use of feedback circuitry and then use this information to control energization of a relay connected to the compressor and defrost heater. Typically, a thermostatic device or cold control is disposed in the refrigerator cabinet to maintain the temperature in the refrigerator cabinet within a range of a consumer selected temperature by controlling energization of the compressor during the cycle.

SUMMARY OF THE INVENTION

It is an object of the present invention to provide a refrigerator control system utilizing adaptive defrost techniques having even greater cost efficiency than prior art systems. Another object of the invention is to provide an adaptive defrost control which is reliable in operation as well as cost efficient, yet is relatively inexpensive.

Briefly, in accordance with a first embodiment of the invention, a microprocessor is employed to control both adaptive defrost control and cabinet temperature control functions. The temperature of the refrigerator cabinet is monitored with a temperature sensor, such as a thermistor, to provide a signal when the temperature of the cabinet equals the temperature selected by a user. The signal is fed to the microprocessor which controls the energization of the compressor motor accordingly through independent relays. Time of energization of the compressor motor and the defrost heater is monitored by the microprocessor through respective high impedance networks. According to a feature of the invention, the relay contacts are operated at or close to the zero current crossing point in order to improve relay cycle life and allow the use of lower cost relays.

According to a second embodiment of the invention, the microprocessor used for adaptive defrost is also used to provide the motor starting control of the compressor motor. A positive temperature coefficient of resistivity (PTC) element is preferably used to establish motor torque and to perform a soft start function. A relay controlled by the microprocessor switches out the PTC element once the motor start function has occurred to conserve power and provide quick motor restart capability. According to a feature of the invention, a single pole, double throw relay is used to direct current flow to the motor compressor or defrost heater while a double pole, single throw relay controls the energization of the PTC element as well as contacts in the defrost heater network.

According to a modification of the second embodiment, the PTC element may be omitted and the same microprocessor controlled relay made to open after a selected time delay, for example, 5–10 seconds, to provide the motor start function.

According to another embodiment of the invention, the separate high impedance feedback networks coupled to the microprocessor which provide a signal whenever the compressor motor or defrost heater is energized are replaced by a single inductive sensor. The signal of this sensor, combined with bit checking on the microprocessor's port registers used to control the relays and maintain a relay status flag, provides the necessary information for determining the time of energization of each of the compressor motor and defrost heater.

According to a feature of the invention, accumulated compressor and defrost heater run times are determined by utilizing a calibration procedure which creates selected time intervals, e.g., 30 second time intervals, as time units based on the 60 Hertz frequency of line power. According to yet another feature of the invention, a filtering procedure is provided to distinguish between signals and noise by comparing the length of time of a logic level high voltage condition to a selected period of time. If the logic level high voltage condition is present more than the selected time, it is determined to be a signal otherwise it is determined to be noise.

DESCRIPTION OF PREFERRED EMBODIMENTS

Figure 1:
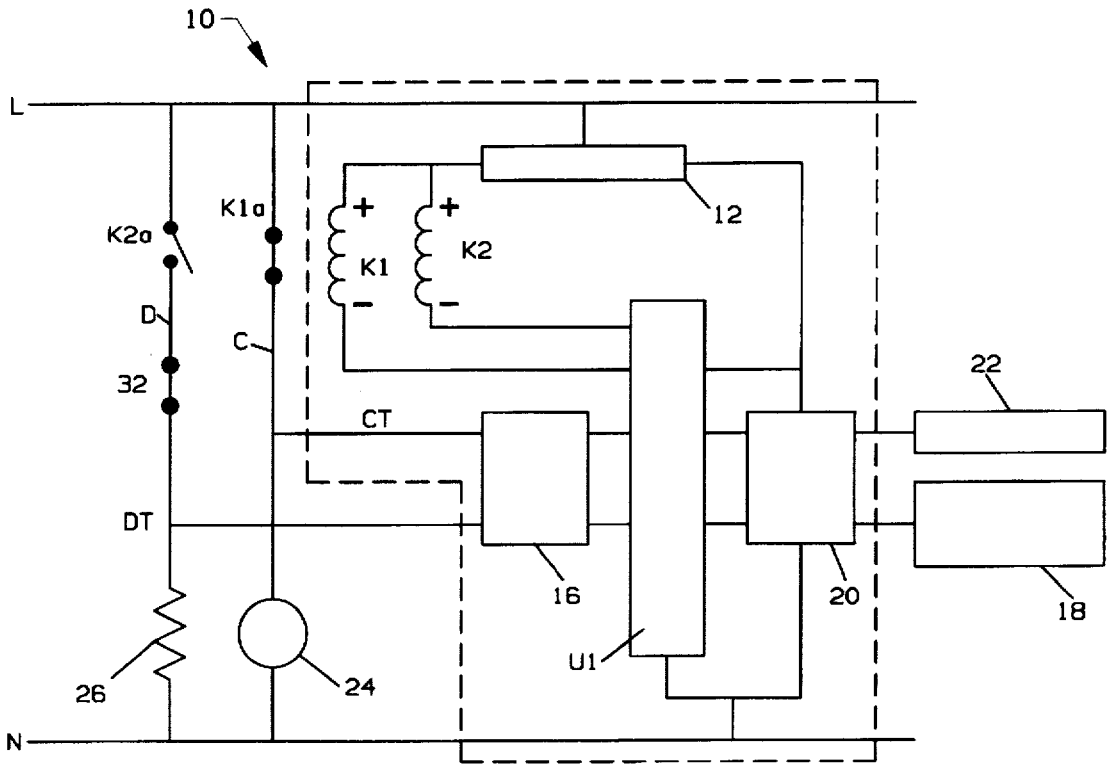
FIG. 1 is a block diagram of an adaptive defrost heater and cabinet temperature control system also showing a compressor motor and a defrost heater.

Referring now to FIG. 1, an adaptive defrost and refrigerator cabinet temperature control system 10 is shown comprising a linear power supply 12, a microprocessor U1, high impedance networks 16, a temperature sensor such as a negative coefficient of resistivity sensor 18 disposed in a suitable location to detect the temperature of the refrigerator cabinet, signal conditioning circuitry 20 and a temperature setting device such as a rheostat 22. Power supply 12 converts the AC line voltage to DC supplying a dual voltage of 5 volts to energize the control circuitry, including the microprocessor, and 24 volts for the operation of single pole, double throw relays K1, K2. Relay K1 is used to control the energization of the refrigerator's compressor 24 and a separate relay K2 is used to control the energization of a defrost heater 26.

When power is first applied, contacts K1*a* of relay K1 are closed and contacts K2*a* of relay K2 are open so that compressor 24 is energized through line C. Line C, at CT, is coupled to microprocessor U1 through a high impedance network 16 so that the compressor on time can be monitored. When power is first turned on, the compressor cycles on and off as dictated by temperature sensor 18 and control 22 set by the user, that is, the temperature of the cabinet is lowered until it matches the temperatures determined by control 22 and cycles within a selected hysteresis band at that temperature. This continues for a fixed total accumulated period of time followed by opening of contacts K1*a* and energization of relay K2 to close contacts K2*a* to energize defrost heater 26 in line D. Line D, at DT, is coupled to microprocessor U1 through high impedance network 16 so that the time of heater energization can be monitored. The defrost heater remains energized until a defrost heater thermostat 32 opens circuit completing a compressor/defrost cycle. Starting with the next cycle, the total accumulated operating time of the compressor is adjusted according to a program to be described below.

Figure 2:
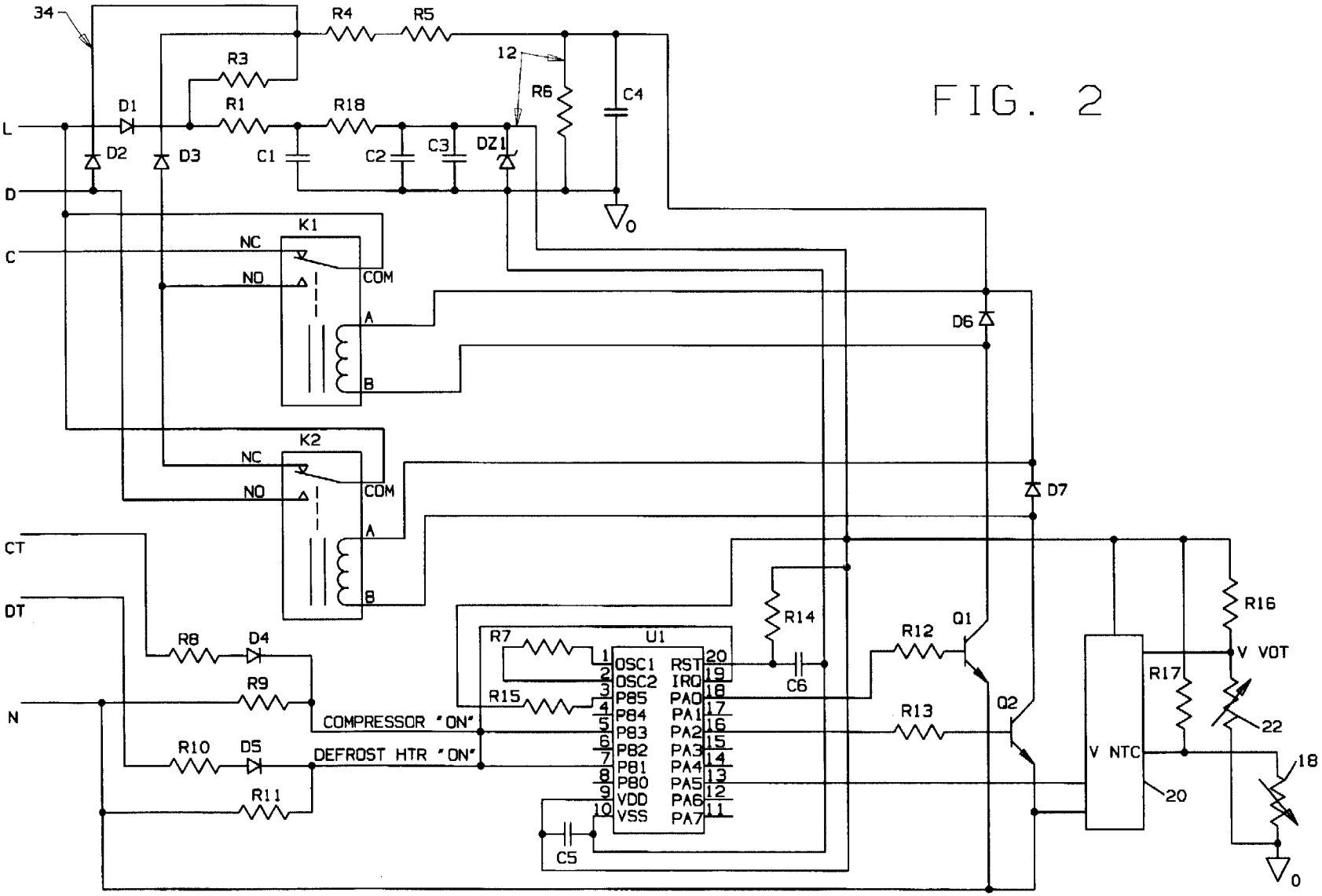
FIG. 2 is a schematic of the control system portion of FIG. 1 shown in greater detail.

More specifically, with reference to FIG. 2, relay K1 is shown as a single pole, double throw relay which has normally closed contacts connecting line L to the compressor while relay K2, also a single pole, double throw relay, has normally closed contacts connecting line L to the power supply network 34 to be discussed below. The normally open contacts of relay K2 are connected to line D which is coupled to the defrost heater while the normally open contacts of relay K1 are connected to the power supply network 34. This arrangement allows energization of relays K1, K2 only when needed to minimize power consumption.

Diode D1 half wave rectifies the AC signal from line L which is current limited by resistors R1, R3, R4 and R5. Capacitors C1, C2, C3, resistor R18 and zener diode DZ1 comprise a 5 volt, linear power supply used to power microprocessor U1. Resistors R4, R5, R6 and capacitor C4 comprise a 24 volt linear power supply used to energize relays K1, K2.

Resistor R14 and capacitor C6, connected to the 5 volt power supply and reset pin 20 of microprocessor U1, comprise an RC network used for power up reset in a conventional manner. Resistors R8 and diode D4 in line CT and resistor R9 connected between the cathode of diode D4 and neutral comprise a voltage divider and serve as a high impedance network connected to input pin 5 of microprocessor U1. The AC signal is half wave rectified and reduced to 5 volts to provide a pulse signal to the microprocessor when the compressor is energized.

Likewise, resistor R10, diode D5 and resistor R11 form a voltage divider and high impedance network connected to input pin 7 to provide a 5 volt pulse signal when the defrost heater is energized. It will be noted that input pins 5 and 7 are also connected to the IRQ pin 19 to enable the use of a zero crossing switching, time interval calibration and noise discrimination routines to be discussed below. Resistor R7 tied between pins 1 and 2 provide a selected frequency for the microprocessor oscillator.

Output pins 18 and 16 are connected through respective base resistors R12, R13 to respective NPN transistors Q1, Q2 to provide a connection from 24 volt rail to neutral N. Transistors Q1 and Q2 are used to control operation of respective relays K1, K2.

Capacitor C5 connected between VDD pin 9, attached to the 5 volt rail and VSS pin 10, analog ground, is used to limit transients.

When relay K1 is energized to close the normally open contacts, diode D3 bypasses a relatively large resistor R3 to connect line voltage to smaller resistors R4, R5 and capacitor C4 to supply the needed current for relay K1 thereby minimizing power consumption. Diode D2 functions in the same manner for relay K2.

Junction $V_{pot}$ of a voltage divider comprising resistor R16 and a variable resistor such as a rheostat 22 and junction $V_{ntc}$ of a voltage divider comprising resistor R17 and NTC sensor 18 are connected to conditioning circuit 20 which in turn is coupled to microprocessor U1 through resistors R15 at input pin 3 and output pin 13. It will be understood that other temperature dependent devices such as RTDs or PTC elements could be used, if desired.

Figure 3A:
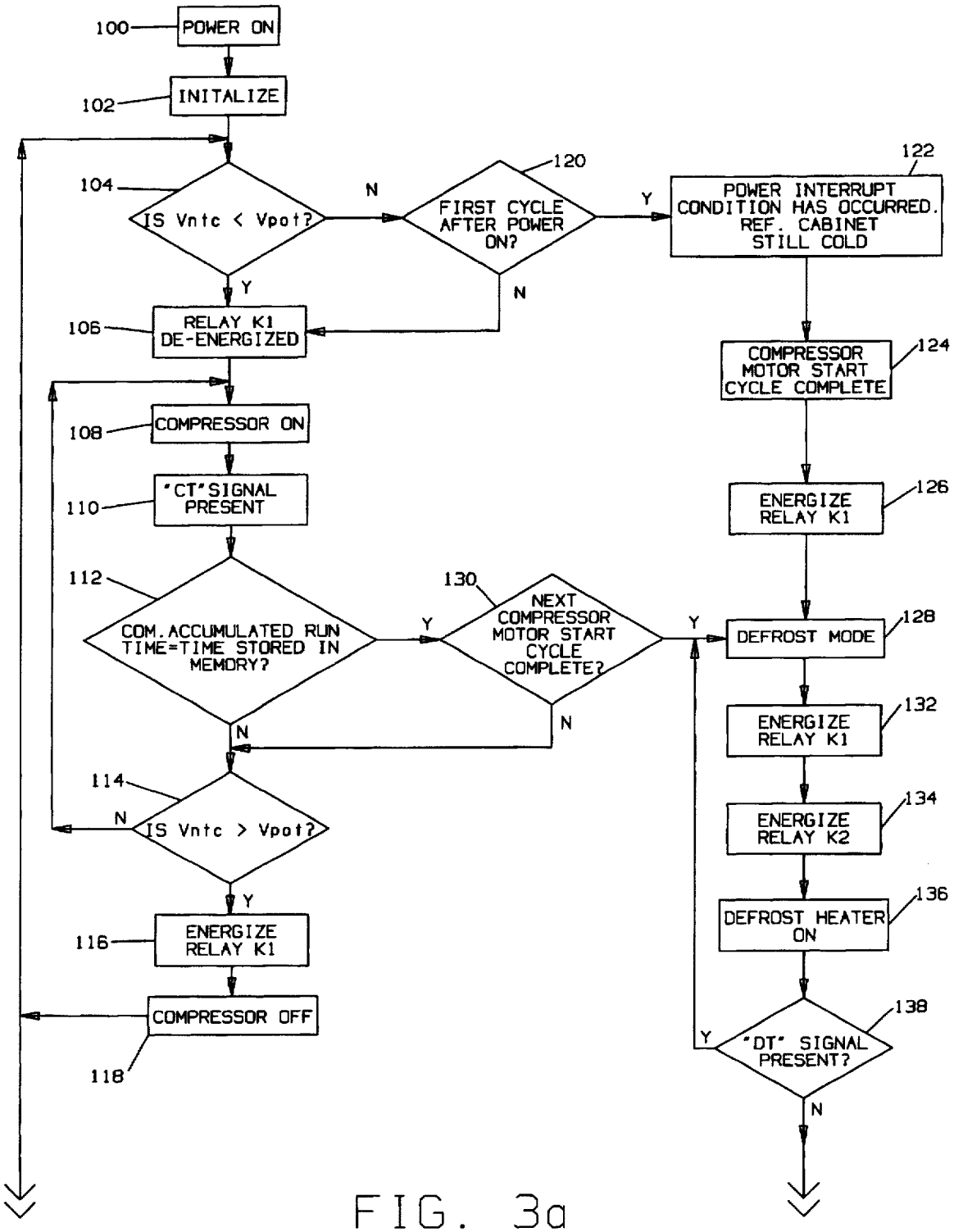
FIGS. 3*a* and 3*b* together comprise a flow chart of the operation of the FIGS. 1, 2 system.
Figure 3B:
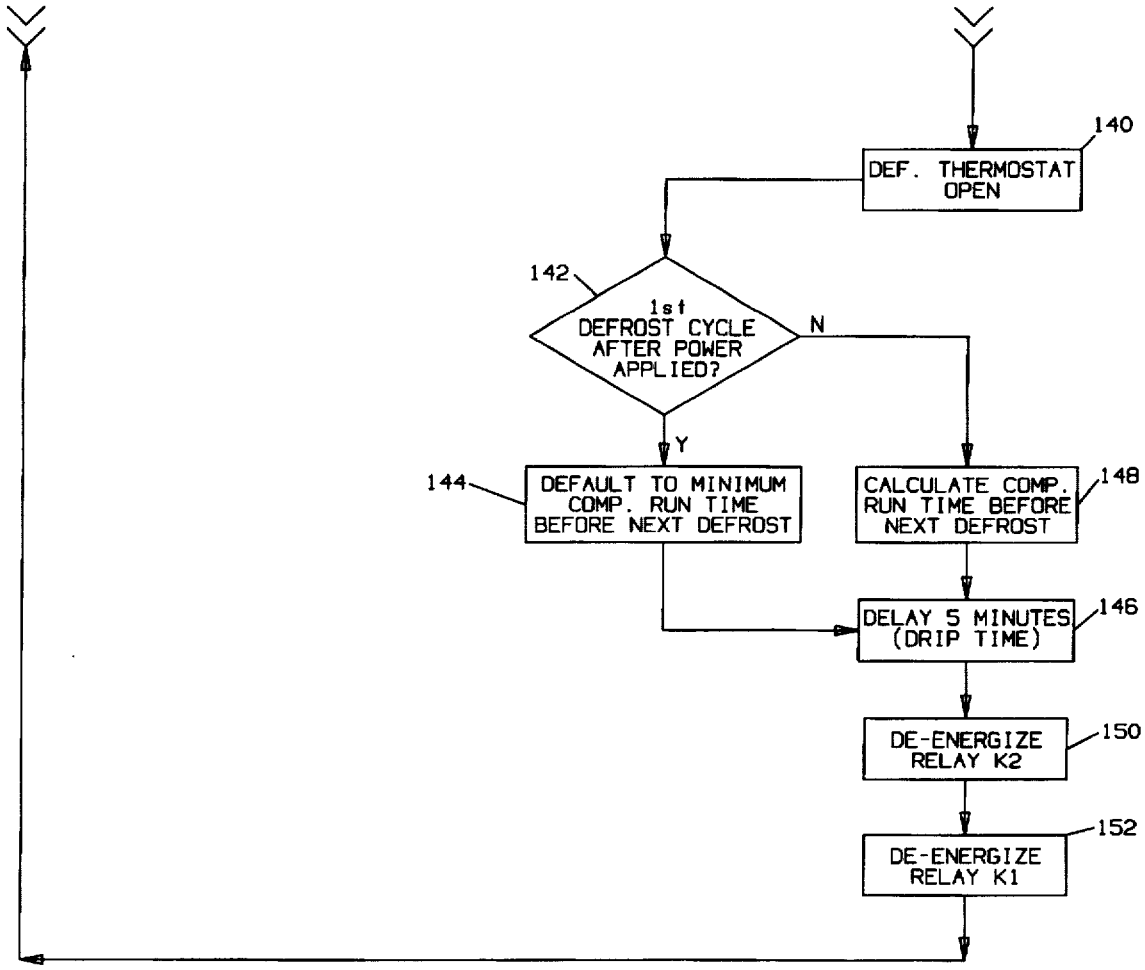

With reference to FIGS. 3*a*, 3*b*, following the turning on of power at step 100 and initialization at 102, decision block 104 compares the voltage across NTC thermistor 18 and rheostat 22 to and, if the voltage across NTC thermistor 18 in less than that across rheostat 22 indicating that the temperature in the cabinet exceeds the consumer temperature setting and therefore the resistance of thermistor 18 is low, relay K1, normally de-energized with contacts K1*a* closed is positively de-energized at step 106. Thus, compressor 24 is on (step 108) providing a CT signal at step 110. A decision at block 112 determines whether the accumulated run time of the compressor has reached the quantity of time stored in memory, e.g., a selected number of hours, if not, the voltage across thermistor 18 and rheostat 22 is again checked at decision block 114 and if the voltage across thermistor 18 does not exceed that across rheostat 22 the program loops back to process step 108 and stays in that loop until either the accumulated run time of the compressor 112 reaches the time stored memory or the voltage across thermistor 18 exceeds that across rheostat 22 in which case relay K1 is energized at step 116 turning off the compressor at step 118 and then loops back to decision block 104. When the voltage across thermistor 18 is greater than that across rheostat 22 the routine goes from decision block 104 to decision block 120 to determine whether it is the first cycle after the power is turned on. If not, the routine goes to process step 106 and goes through the entire loop again. If decision block 120 determines that it is the first cycle after power has been turned on, this indicates that a power interrupt has occurred with the refrigerator cabinet still at a relatively cold temperature, block 122 and at block 124 that a compressor motor start cycle has been completed. Relay K1 is then energized at block 126 in preparation of going into the defrost mode at block 128.

In the event that decision block 112 determines that the accumulated run time of the compressor has reached the time stored in memory and if the next compressor motor operating cycle has been completed, decision block 130, then the routine goes to the defrost mode, block 128 and relay K1 is energized, block 132. If decision block 130 determines that the next compressor motor cycle has not been completed then it cycles through decision block 114 another time. Following process block 132, relay K2 is energized at block 134 to energize defrost heater 26, block 136. Decision block 138 determines whether a DT signal is present and, if present, the routine loops back to defrost mode step 128. If the DT signal is not present, this signifies that the defrost thermostat is open, block 140, and decision block 142 determines whether this is the first defrost cycle after power is applied. If yes, the routine defaults (block 144) to a minimum accumulated compressor operating or run time before the next defrost cycle and then goes to a five minute delay or drip time, block 146. If the decision of block 142 is no, then the next step at block 148 is to calculate the next accumulated compressor run time needed before the next defrost cycle based on the time required for defrost. The routine then goes to the delay time of block 146 followed by de-energization of relay K2, block 150, and then relay K1, block 152. From this point the routine goes back to decision block 104 to compare the temperature of the refrigerator cabinet with the temperature selected by the user.

Figure 4:
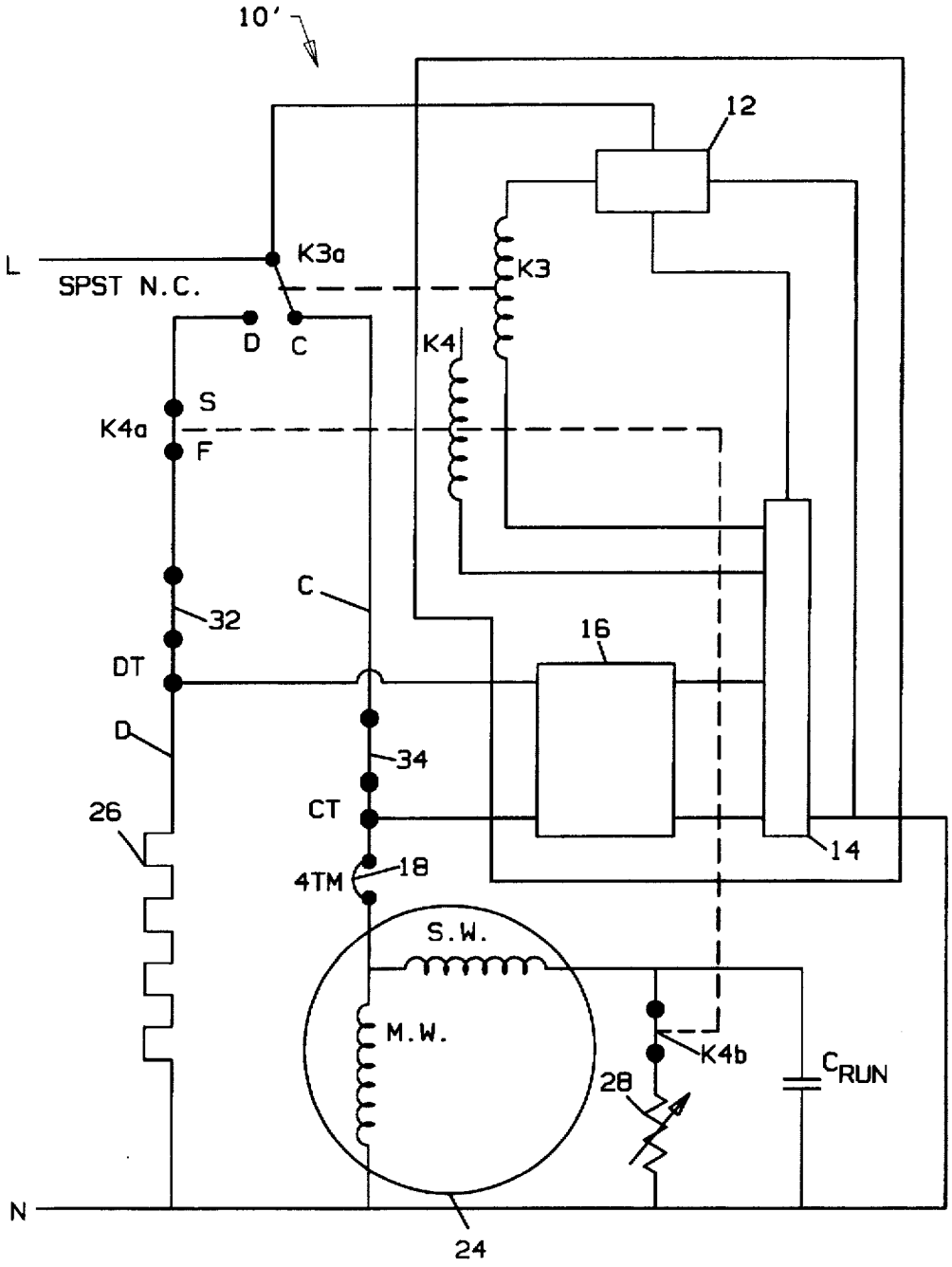
FIG. 4 is a schematic of another embodiment of a control system for demand defrost of a refrigerator showing an energy efficient compressor motor starter.
Figure 5:
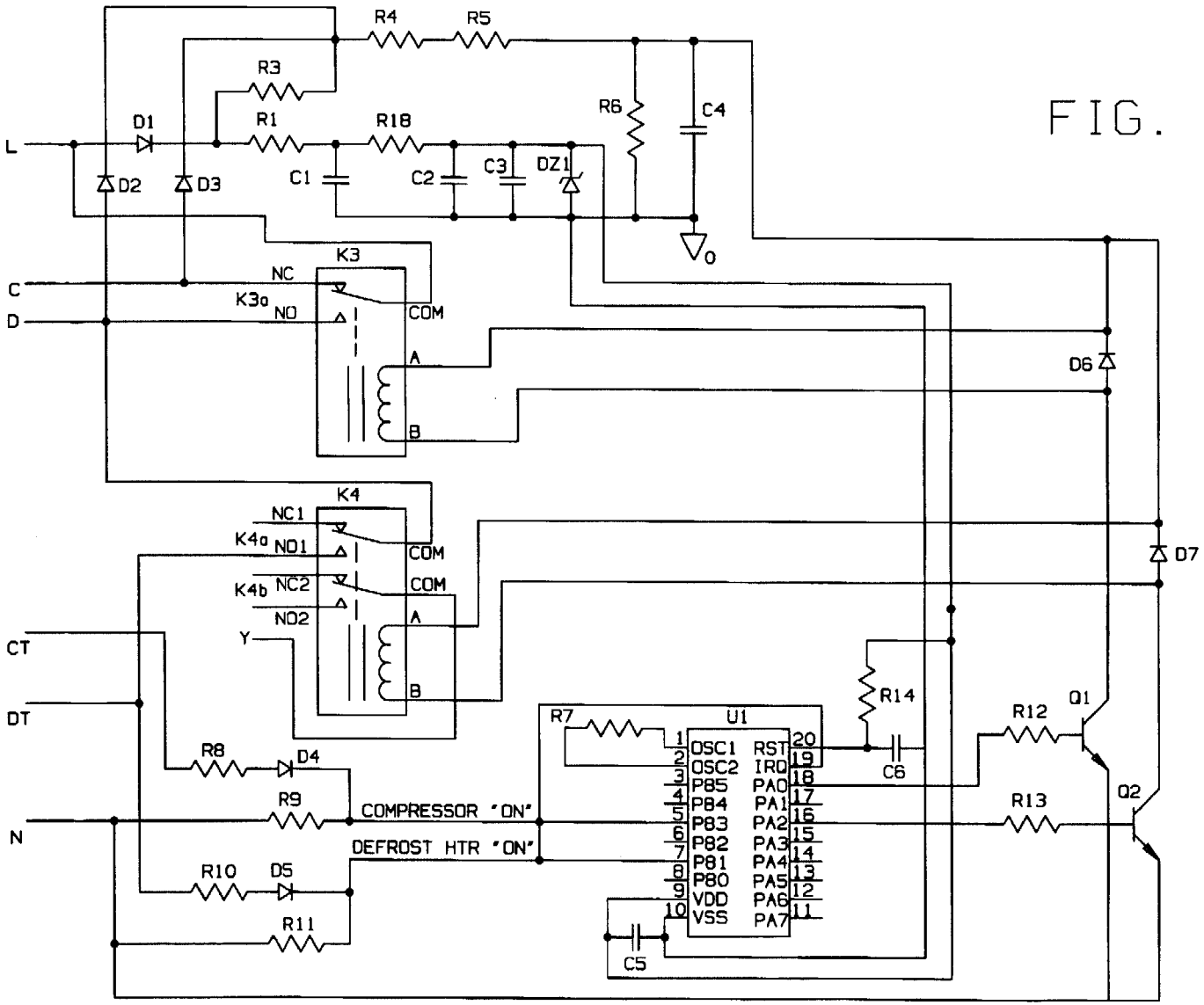
FIG. 5 is a schematic of the control system portion of FIG. 4 shown in greater detail.

A modified embodiment of the invention is shown in FIGS. 4 and 5 in which the motor starter function of the compressor motor is integrated into the control system 10'. A single pole, double throw relay K3 has a movable contact K3*a* normally closed in line C connected to compressor motor 24 and movable to normally open line D connected to defrost heater 26 upon energization of relay K3. A second relay K4, a double pole, single through relay, has normally closed contacts K4*a* in line D and normally closed contacts K4*b* serially connected to a positive temperature coefficient of resistivity (PTC) element 28 connected between start winding SW and neutral N. A run capacitor $C_{run}$ is connected across PTC element 28 and contacts K4*b* in a conventional manner. A cold control thermostat 34 is shown connected between the CT line and relay contacts K3*a*; however, it will be understood that the temperature sensor 18 arrangement of FIG. 1 could be used, if desired.

When power is first applied contact K3*a* is connected to line C and contact K4*b* is closed with PTC element 28 in a low resistance state. The PTC element 28 switches to high resistance in approximately one second completing the motor start function of the compressor motor. After a selected delay, e.g., approximately 5–10 seconds, double pole relay K4 is energized opening the circuit to PTC element 28 (contact K4*b*) in order to conserve power and provide quick motor restart capability. The CT signal is received by microprocessor 14 as in the FIGS. 1, 2 embodiment. The cessation of the CT signal reflects that the cold control thermostat 34 has open circuited as a result of the temperature of the refrigerator cabinet having decreased to the consumer setting. When the cabinet temperature then increases to a given level above the consumer setting and the cold control closes the cycle is repeated. Compressor run time is accumulated in the same manner as in the FIGS. 1, 2 embodiment.

Figure 6A:
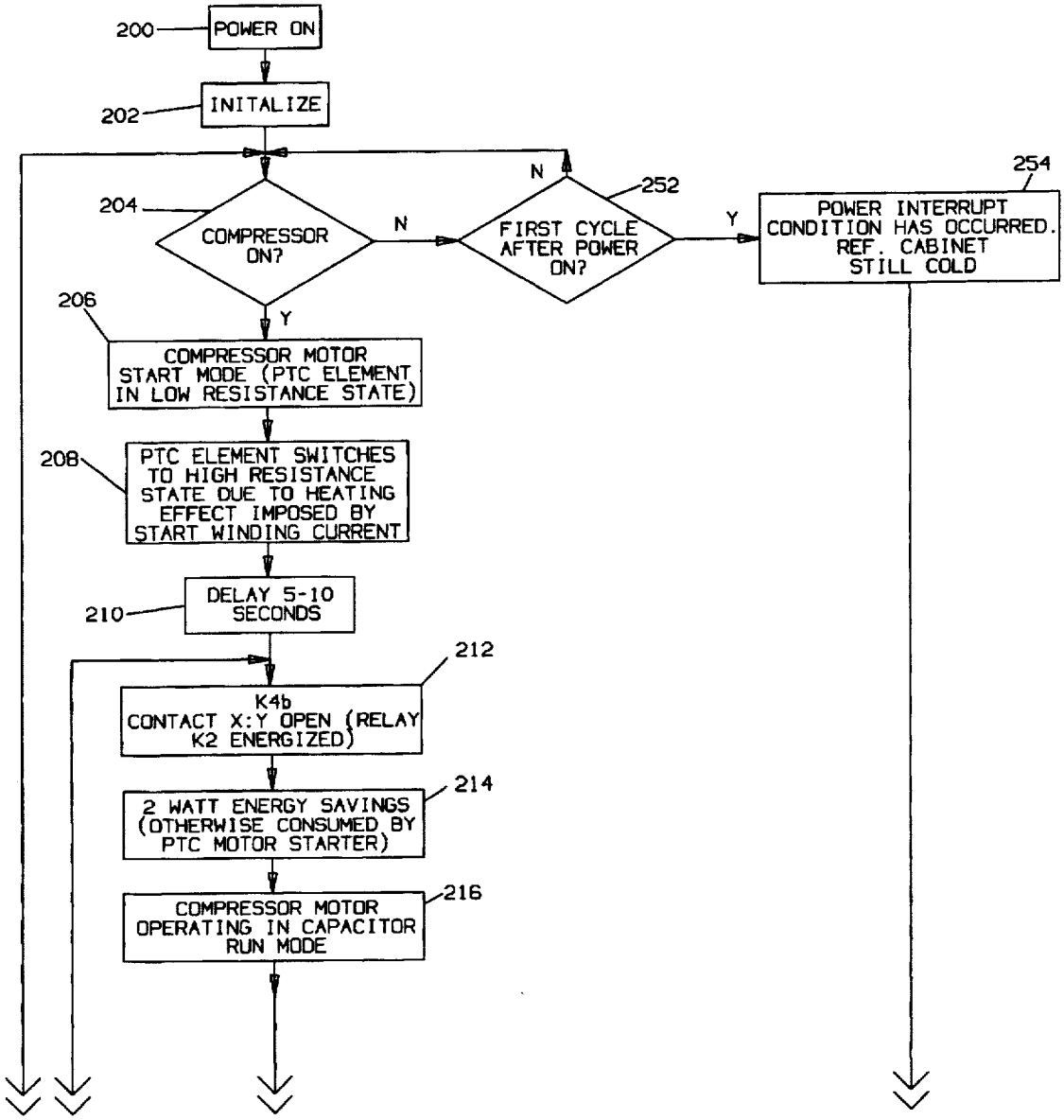
FIGS. 6*a* and 6*b* together comprise a flow chart of the adaptive defrost heater system and motor starter operation of the microprocessor.
Figure 6B:
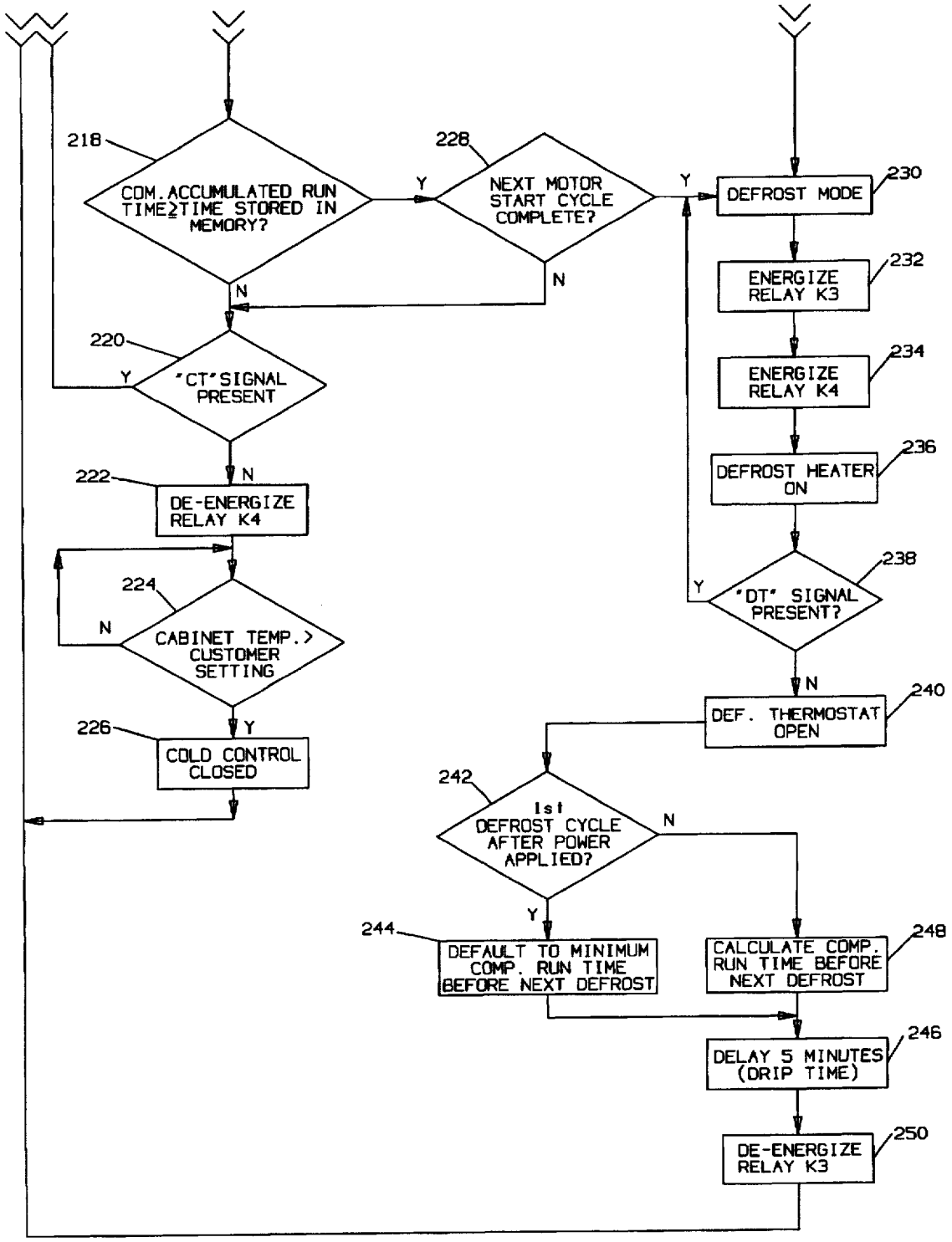

As seen in FIGS. 6*a*, 6*b*, power is turned on and the control is initialized at process steps 200, 202, respectively. If the compressor is on as determined in decision block 204, the compressor motor is in the start mode with PTC element 28 in the low resistance mode, process step 206. PTC element 28 then switches to the high resistance state due to the heating effect caused by start winding current at process step 208. After a selected delay, e.g., of approximately 5–10 seconds, process step 210, relay K4 is energized opening contacts K4*b* (process step 212). This results in a savings of approximately 2 watts as noted in block 214. The compressor motor then operates in the capacitor run mode (step 216). Decision block 218 compares the accumulated compressor run time to the time stored in memory and if the accumulated time is less than the stored time decision block 220 determines if the CT signal is present. If the CT signal is present, the routine loops back to the process block 212. If the CT signal is not present relay K4 is de-energized at process step 222 followed by decision block 224 which determines whether the refrigerator cabinet temperature is higher than the customer setting and if not the routine keeps looping around decision block 224 until the cabinet temperature exceeds the selected setting at which point the cold control thermostat 34 is closed (step 226) with the routine then looping back to decision block 204.

If the accumulated run time has reached the time stored in memory a decision block 218, decision block 228 then looks to see if the first motor start cycle following that point has been completed and if not the routine goes to decision block 220. When the decision of block 228 is positive the routine then goes to the defrost mode (block 230) and relay K3 is energized and relay K4 is de-energized (blocks 232, 234, respectively). At this point defrost heater 26 is energized (block 236) and the decision block 238 looks to see if the DT signal is present. If the DT signal is present the routine goes back to process block 230 and stays in that loop until the DT signal is absent when defrost thermostat 32 opens (block 240). The routine then goes to decision block 242 to determine whether this was the first defrost cycle following the application of power and if so the routine defaults at block 244 to a minimum compressor run time before the next defrost cycle followed by a drip delay time of five minutes (block 246). If decision block 242 determines it was not the first defrost cycle after the application of power, the next compressor run is calculated (step 248) followed by the delay time of block 246. Relay K3 is then de-energized at step 250 with the routine then returning to decision block 204 to repeat the entire sequence.

With reference to decision block 204, if it is determined that the compressor is not on decision block 252 looks to see if it is the first cycle following the application of power and if not it loops back to decision block 204 but if it is the first cycle then the routine goes to step 254 indicating that a power interrupt condition has occurred with a refrigerator cabinet still colder than the consumer setting with the routine proceeding to defrost mode step 230.

Figure 7:
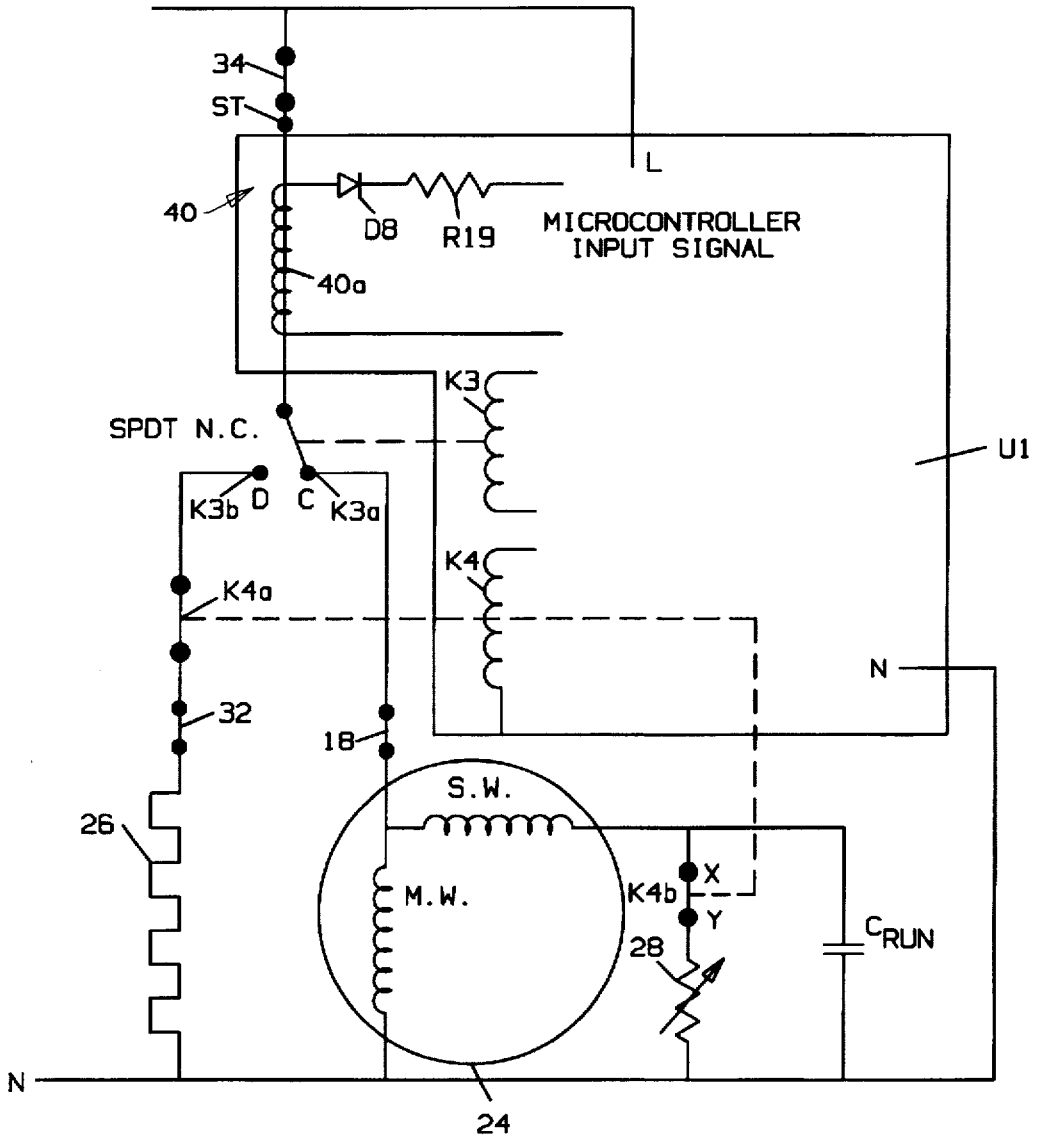
FIG. 7 is a schematic, similar to FIG. 4, of a modified embodiment of the FIG. 4 system.

FIG. 7 shows a modification of the FIGS. 4, 5 system in which a single inductive sensor 40, such as a toroid, is used to detect operation of compressor motor 24 or defrost heater 26. The use of a sensor 40 comprising a toroid transformer with the line carrying current to contacts K3*a* or K3*b* to energize the compressor motor or defrost heater serves as a single turn primary and obviates the need for high impedance network 16. As shown in FIG. 7, cold control 34 is placed between line L and the contacts of relay K3 so that a signal ST is present when power is applied through cold control 34 in either position of relay K3 as long as motor protector 18 is closed when relay contact K3*a* is closed and relay contacts K4*a* and defrost heater thermostat 32 is closed when relay contact K3*b* is closed. A multi-turn winding 40*a* provides a signal to microprocessor U1 through appropriate conditioning circuitry such as diode D8 and a voltage divider network including resistor R19. If desired, a suitable amplifier stage could be used.

The state of relay K3, i.e., whether normally closed (compressor) contacts K3*a* or normally open (defrost heater) contacts K3*b* are closed is determined by bit checking of the port registers of microprocessor U1 used to control the relay and maintain a status flag. This information, along with the presence of an ST signal detected by sensor 40, is then used to monitor the respective times of energization of the compressor motor and defrost heater.

The FIG. 7 embodiment enhances noise immunity through circuit isolation and filtering, provides controller protection through isolation of the high AC current from low voltage microprocessor input capability.

Figure 8:
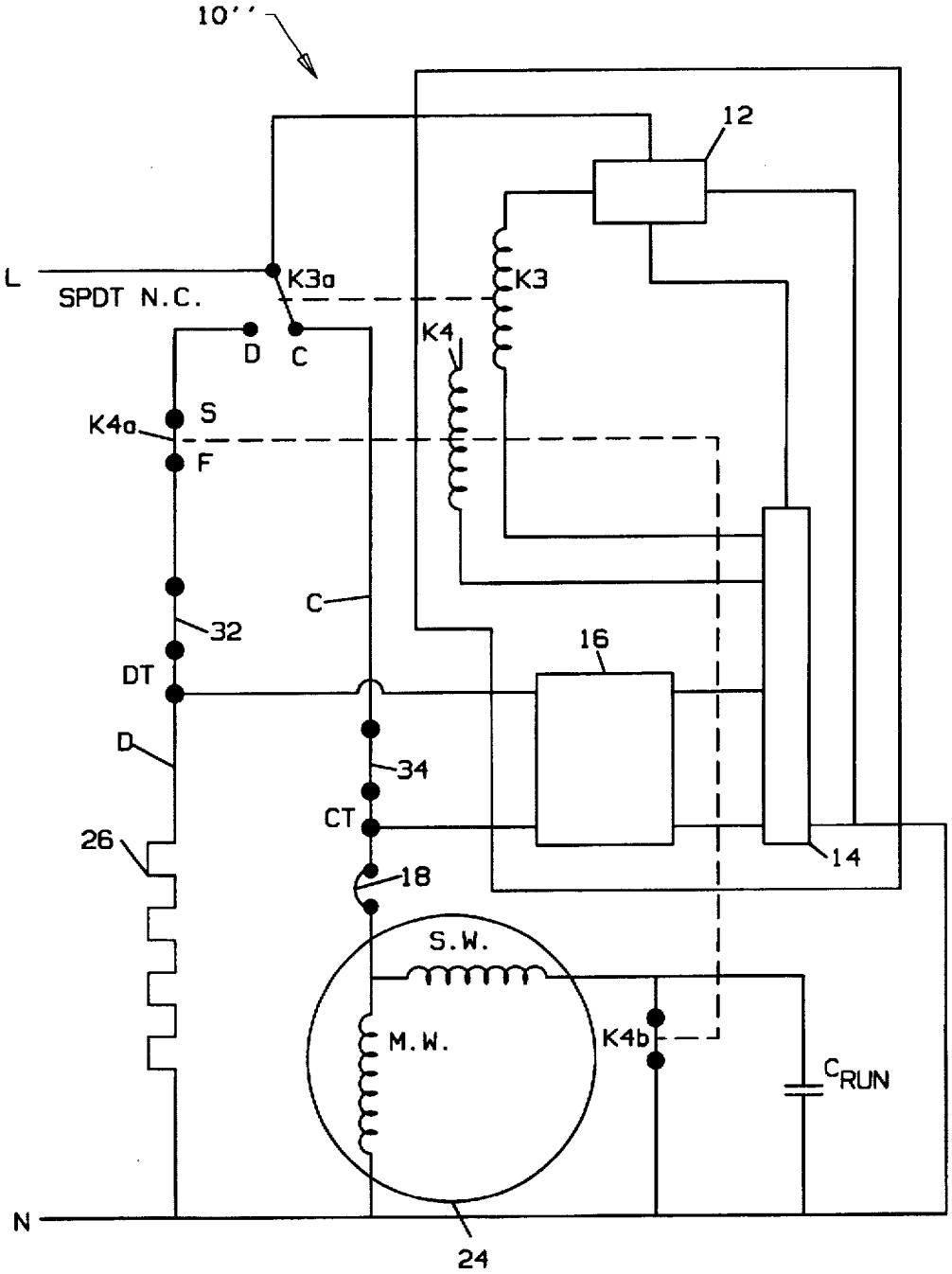
FIG. 8 is a schematic, similar to FIG. 4, of a modified embodiment of the FIGS. 4, 7 systems.

According to a modification of the FIGS. 4 and 7 embodiments, as shown in FIG. 8, relay K4 can be used to start compressor motor 24 without using PTC element 28, if desired. Control system 10" of FIG. 8 is identical to FIG. 4 with the exception that PTC element 28 of FIGS. 4 and 7 has been omitted so that the description of the circuit need not be repeated. Since controller U1 is programmed to open circuit contact K4*b* after a selected time, e.g., 5–10 seconds (see step 210 of FIG. 6*a*), the motor will start and operate in the capacitor run mode. Although the use of PTC element 28 (FIGS. 4 and 7) results in having contact K4*b* open on microamps of current as opposed to amps (FIG. 8) to thereby provide a soft start, if desired, motor 24 nevertheless can be started using a hard start associated with using only a relay contact.

According to another feature of the invention which can be used with any of the above embodiments, relay life is enhanced by minimizing contact current and voltage during switching. Ideal switching would occur when the current equals zero. In the present application, a common relay contact is switched from a normally closed (NC) compressor circuit contact K3*a* to a normally open (NO) heater circuit contact K3*b*. Since there is approximately a 3 millisecond delay between NC contact break and No contact make, it is impossible to achieve zero current both for NC break and NO make with respect to relay K3. The optimal result, therefore, is to coordinate the switching events around the time that the current drops to zero so that both compressor and heater currents are approximately equal in magnitude (but of opposite polarity). Equal currents would result in nearly equal contact wear. Excessive wear on any one contact would result in an early failure of the entire device. However, equal switching currents are feasible (with the three millisecond delay) when both instantaneous currents are approximately 2 amps (heater peak current 6.2 amps and compressor peak current 2.4 amps). In one particular system made in accordance with the invention, these optimal switching events can occur when a precise five millisecond delay is included between an IRQ* external interrupt and the energization of the relay. However, the creation of a precise 5 millisecond delay is problematic due to the +/−50% variability of the microcontroller's internal oscillator from one component to another. To circumvent this problem a precise delay is provided by counting internal clock cycles that occur during one AC cycle. One 60 Hertz AC cycle lasts 16.6 milliseconds. The beginning and end of one AC cycle can be detected by two sequential IRQ* external interrupts. Therefore clock cycles can be counted using loop structures that run between two interrupts. To arrive at one millisecond time increments, the clock cycle count is divided by 16 (16.6 millisecond in one AC cycle). The division by 16 occurs by bit shifting the register (accumulator) containing the cycle count four times. Division by two is equivalent to shifting the binary contents of a register one bit to the right. This process results in a one millisecond period with less than +/−10% error between component lots. A five millisecond delay can be achieved by cyclically down counting for five periods each equal to the derived one millisecond period.

Figure 9:
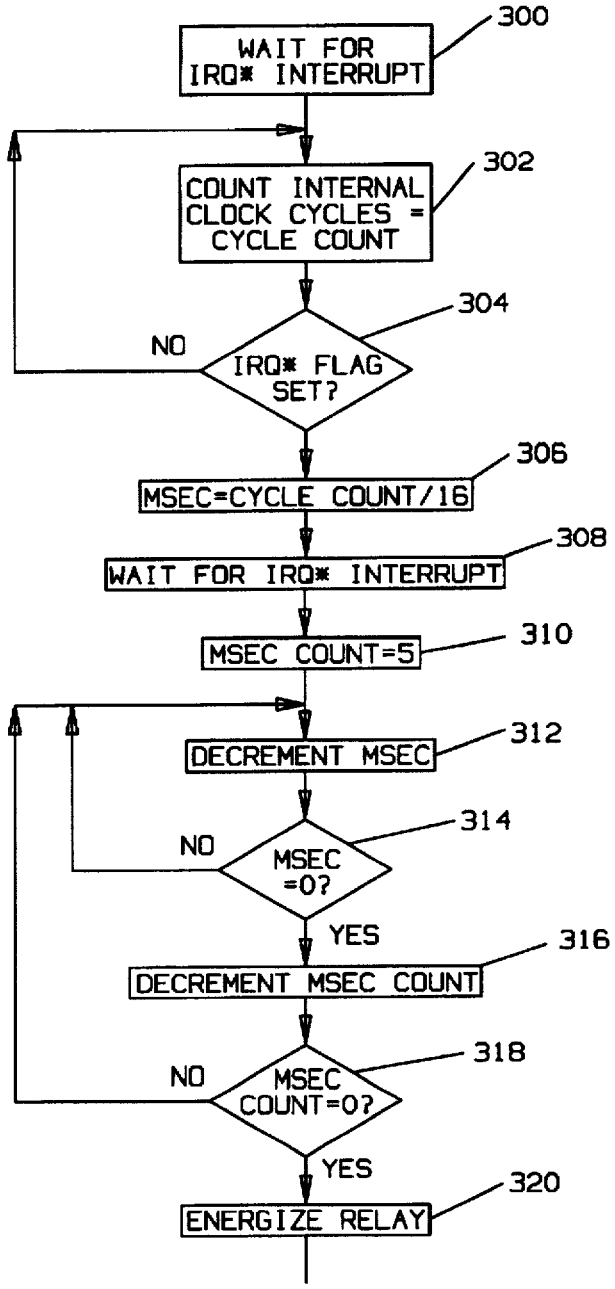
FIG. 9 is a flow chart of a program for operating the systems' relays using a zero crossing technique.

With reference to the flow chart shown in FIG. 9, the program commences at process step 300, wait for IRQ* interrupt. As noted in FIGS. 2 and 5, the IRQ pin 19 of microprocessor U1 is coupled to the CT and DT lines which receive the attenuated 60 Hz of the line frequency. The assembly language "wait" instruction, used as a starting point for the time measurement of the AC cycle, freezes the microcontroller's operation until an IRQ* interrupt occurs (less than 16.6 milliseconds) which occurs just as the AC voltage approaches zero volts. After the interrupt occurs, the microcontroller resumes execution of instructions. At process step 302, count internal clock cycles, the code sequence (not shown) in essence counts the internal clock cycles that occur during one AC cycle (16.6 milliseconds). A variable ms is a scaled value that is proportional to the actual internal clock cycles that occur during one AC cycle. Somewhere between approximately 4,000 to 12,000 actual clock cycles will occur during one AC cycle because of clock variations throughout component lots. Using a scaled value such as ms permits the counting of clock cycles in one eight bit variable. The variable ms is subsequently divided by 16 to arrive at a cycle count equivalent to one millisecond. Decision block 304, IRQ* FLAG SET checks to see if the 3rd bit of IRQ* Status and Control Register is clear. If the bit is clear, the next IRQ* interrupt (end of one AC cycle) has not yet occurred and the program branches back to process step 302 to resume incrementing ms. When one AC cycle has been completed, no branching will occur and the value of ms will be fixed. At step 306, MSEC=CYCLE COUNT/16, the scaled cycle count equivalent to one millisecond is calculated by dividing the variable ms by 16. Division by 16 is performed by four consecutive logical shift right instructions which are performed by looping (not shown). At step 308, WAIT FOR IRQ* INTERRUPT, the IRQ* interrupt associated with this wait instruction initiates the relay switching sequence. After the interrupt occurs, a five millisecond delay commences. At step 310, MSEC COUNT=5, the variable "msc" is set equal to the number of milliseconds required in the subsequent delay. Although the specific time delay may vary when different components are used in the system, e.g., different compressor motors or relays, a five millisecond delay was used in one system made in accordance with the invention. At process step 312 and decision step 314, DECREMENT MSEC, MSEC=0?, this sequence of instructions creates a one millisecond delay by decrementing the variable ms in a nested loop structure (not shown). One pass through the nested loop takes as many clock cycles as required to make one pass through the loop used to create the ms value originally (prior to division by 16). The result is a fairly precise one millisecond time period. At process step 316, DECREMENT MSEC COUNT and decision step 318, MSEC COUNT=0?, the instructions down count the number of total milliseconds for the delay. MSEC Count=msc=5 before down counting. Finally at step 320, ENERGIZE RELAY, a microcontroller port bit is set thereby energizing the relay by means of the program with switching effected within a +/−10% band of zero crossing.

According to another feature of the invention, the 60 Hz line frequency is used to determine the amount of "on" time of the compressor and the defrost heater. The following description relates specifically to the FIGS. 4, 5, 7 and 8 embodiments which utilize a conventional cold control but it will be understood that it can be used in the FIGS. 1, 2 embodiment as well by referencing the CT signal.

The timing procedure creates a precise 30 second time interval that is used as a basis for calculation of accumulated compressor and defrost heater run times. This accumulated heater and compressor run times can span from minutes to hours respectively. The clock calibration procedure is made up of various assembly language statements spread throughout the adaptive defrost control program including some subroutines.

Figure 10:
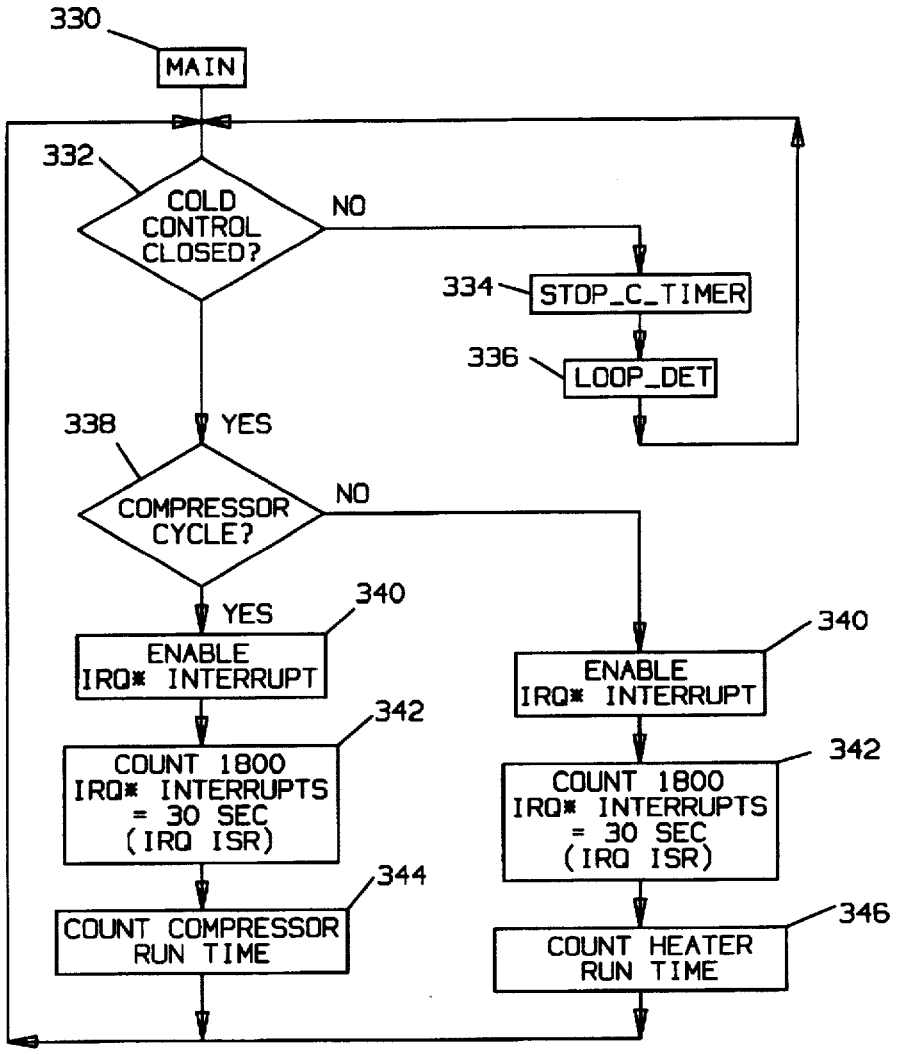
FIG. 10 is a flow chart of a clock calibration program used for accumulating the run time of the compressor and defrost heater in the above embodiments.

With reference to FIG. 10, block 330, MAIN, the key commands that initiate the calibration procedure are included in the main loop of the microcontroller program. The main portion of the program includes the initialization of the register used for external interrupt control. The timed 30 second interval begins when an external interrupt (IRQ*)

is enabled and then is subsequently triggered by a falling edge (toward zero volts) voltage. The voltage triggering the IRQ* interrupt is an attenuated half wave version of the AC line voltage. If the cold control is closed as determined at decision block 332, COLD CONTROL CLOSED?, time interval calculation based on accumulated interrupt intervals (autocalibration) commences. If the cold control is open, the program goes into a standby mode during which the counting intervals ceases. The standby mode consists of branching to the "stop_c_timer" function, step 334 and executing the "loop13 det" subroutine 336. The program exits the standby mode when the cold control closes. When the cold control is closed the routine goes to decision block 338 COMPRESSOR CYCLE?. This control structure determines if relay K3 is in the normally closed compressor-on setting or the normally open heater-on setting. Depending on the relay setting, either compressor or heater operation elapsed times are subsequently calculated using the same process step, 340, Enable IRQ* Interrupt, and stop 342, Count 1,800 IRQ* Interrupts. Step 342, COUNT 1,800 IRQ* INTERRUPTS, the AC line voltage completes 60 cycles in one second. Each AC cycle includes one negative edge trigging event that can cause an IRQ* interrupt. After 1,800 (60×30=1,800) interrupts, an elapsed time of 30 seconds will have passed. The interrupt service routine, ISR, uses each interval of 1,800 accumulated interrupts (30 seconds) as a fundamental time unit to calculate the passage of minutes for heater operation and hours for accumulated compressor operation. The subsequent code in the interrupt service routine, ISR, tallies the number of 30 second intervals that elapse during either a compressor or heater operation to calculate total operation time. With respect to block 344, COUNT COMPRESSOR, the compressor run time is calculated as the accumulation of 30 second intervals into hours (120 thirty second intervals=1 hour). Heater operation time, block 346, is calculated as total number of half minute (30 second intervals). Both calculations are performed by the ISR. The results of the ISR calculations are transferred to the main loop via a flag byte and a global variable. It will be understood that, if desired, different lengths for the time intervals can be employed, e.g., a shorter time interval such as ten seconds to obtain a more accurate time.

Figure 11:
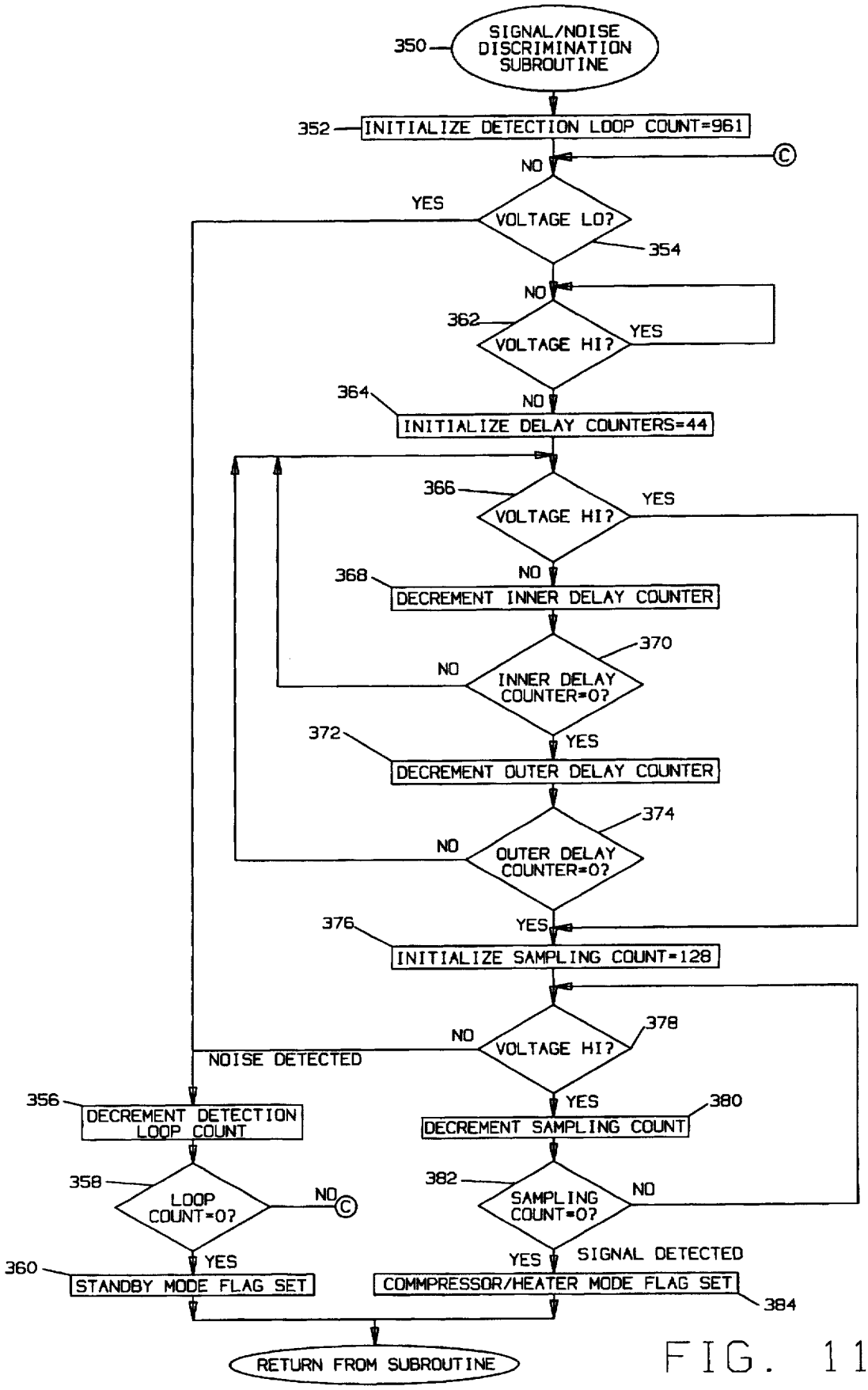
FIG. 11 is a flow chart of a signal/noise discrimination subroutine used in the above embodiments.

According to yet another feature of the invention, a signal/noise discrimination subroutine is utilized to enable the controller to operate in severe noise environments. The signal/noise routine uses a sample and delay algorithm in which sampling counts and delay durations are tailored to operate with a microcontroller having a 1M Hz external oscillator and an attenuated 60 Hz AC line signal. The fundamental assumption used in the subroutine is that the noise interfering with operation consists of short duration spikes of less than 3.3 millisecond duration as contrasted to the 8.3 milliseconds between AC line voltage zero crossings. With reference to FIG. 11, the subroutine 350 commences with step 352, Initialize Detection Loop Count. The routine goes through a loop for up to 961 times looking for a logic level high voltage (decision block 354). The loop includes decrementing detection loop count at block 356, looking to see if the loop count equals zero, decision block 358, and when completed setting a standby mode flag, step 360, and then returning from the subroutine.

Once the voltage goes to a logic level high, decision block 362, another loop is entered and looping occurs until the voltage goes low again. This establishes a starting point of a prospective AC cycle. After the voltage goes to a logic level low the subroutine executes a 51 millisecond sample and delay loop to identify either a noise spike or a proper logic signal level. Delay counters are initialized to 44 at step 364 and then decision block 366 determines if the voltage is high. If the voltage is low an inner delay counter is decremented at step 368 and the decision block 370 looks to see if the decrement has reached zero. If not, the subroutine loops back to decision block 366. If the decrement has reached zero then an outer delay counter is decremented at block 372. Following the decrement of the outer delay counter, decision block 374 looks to see if the outer delay counter has decremented to zero and if not the subroutine loops back to decision block 366. If the outer delay counter has reached zero the loop labeled initialize sampling count=128, block 376, is entered. This loop samples the input for 3.3 milliseconds. If the voltage level remains high for more than 3.3 milliseconds it is considered to be a signal whereas if the voltage level goes low in less than 3.3 milliseconds it is considered to be noise and the program jumps back to the detection loop where the sample and hold process begins again. More specifically, decision block 378 looks to see if the voltage is still high upon entering the loop. If the voltage is high the sampling is decremented at block 380 followed by decision block 382 to see if the sampling count equals zero. If not, the routine loops back to decision block 378. When the sampling count reaches zero it indicates that a signal has been detected and a compressor or heater mode flag is set at step 384 to establish both that the input is a signal and that a particular operational mode is engaged depending upon whether the microcontroller 14 is configured to power the compressor or the heater and then returns to the subroutine.

Upon entering the initialize sampling count=128 loop, step 376, a determination by decision block 378 that the voltage is not high indicates that noise has been detected and the subroutine goes to process step 356 and decrements the detection loop count.

While the invention has been described with reference to certain preferred illustrative embodiments, this description is not intended to be construed in a limiting sense. Various modifications will be apparent to a person skilled in the art upon reference to the description. It is therefore, the intention that the appended claims encompass any such modifications.

What is claimed:

1. An adaptive defrost system for refrigeration apparatus having a compressor motor and a defrost heater comprising a microprocessor and a first set of relay contacts in a first line connected to line voltage and being serially connected to the compressor motor and being movable between first and second positions and a second set of relay contacts in a second line connected to line voltage and being serially connected to the defrost heater and being movable between first and second positions, coil means coupled to the microprocessor for actuating the first and second sets of relay contacts, a power supply for supplying a first low level of power for the microprocessor and a second high level of power for actuating the first and second set of relay contacts, feedback signal means connected to the first and second lines and to the microprocessor so that the microprocessor can monitor the energization of the compressor motor and the defrost heater, means to vary the accumulated operating time of the compressor motor based on the feedback signal, the feedback signal means including a common line connected between line voltage and the respective first and second lines, a toroid having a primary connected to the common line and a secondary connected to the microprocessor.

2. An adaptive defrost system according to claim 1 in which the microprocessor has an IRQ interrupt input and the feedback signal is coupled to the IRQ input and comprising means to count internal clock cycles in a line voltage frequency cycle to determine the number of internal clock cycles in a preselected portion of a line voltage frequency cycle and thereafter provide a delay of a selected number of preselected portions of a line voltage frequency cycle to actuate the relays so that switching will occur when line voltage is at a selected point of the AC voltage wave relative to zero crossing.

3. An adaptive defrost system according to claim 2 in which the preselected portion of a line voltage frequency cycle is one millisecond.

4. An adaptive defrost system according to claim 2 in which the delay is 5 milliseconds.

5. An adaptive defrost system for refrigeration apparatus having a compressor motor and a defrost heater, the compressor motor having a start winding, comprising a microprocessor and a first set of relay contacts in a first line connected to line voltage and being serially connected to the compressor motor and being movable between first and second positions and a second set of relay contacts in a second line connected to line voltage and being serially connected to the defrost heater and being movable between first and second positions, a positive temperature coefficient of resistivity (PTC) element coupled to the start winding and a third set of relay contacts serially connected to the PTC element and being movable between first and second positions, coil means coupled to the microprocessor for actuating the first, second and third sets of relay contacts, a power supply for supplying a first low level of power for the microprocessor and a second high level of power for actuating the first, second and third sets of relay contacts, feedback signal means connected to the first and second lines and to the microprocessor so that the microprocessor can monitor the energization of the compressor motor and the defrost heater and means to vary the accumulated operating time of the compressor motor based on the feedback signal.

6. An adaptive defrost system according to claim 5 in which the feedback signal means includes a high impedance network and each of the first and second lines are connected to the microprocessor through the high impedance network.

7. An adaptive defrost system according to claim 5 in which the first set of relay contacts includes a first stationary contact connected in the first line and a second stationary contact connected in the second line and a movable contact movable between the first and second stationary contacts.

8. An adaptive defrost system according to claim 5 in which the second and third set of relay contacts are part of a double pole, single throw relay.

9. An adaptive defrost system according to claim 5 in which the microprocessor has an IRQ interrupt input and the feedback signal is coupled to the IRQ input and comprising means to count internal clock cycles in a line voltage frequency cycle to determine the number of internal clock cycles in a preselected portion of a line voltage frequency cycle and thereafter provide a delay of a selected number of preselected portions of a line voltage frequency cycle to actuate the relays so that switching will occur when line voltage is at a selected point of the AC voltage wave relative to zero crossing.

10. An adaptive defrost system according to claim 9 in which the preselected portion of a line voltage frequency cycle is one millisecond.

11. An adaptive defrost system according to claim 10 in which the delay is 5 milliseconds.

12. An adaptive defrost system according to claim 5 in which the feedback signal means including a common line connected between line voltage and the respective first and second lines, a toroid having a primary connected to the common line and a secondary connected to the microprocessor.

13. An adaptive defrost system for refrigeration apparatus having a compressor motor, a defrost heater, a microprocessor for controlling energization and de-energization of the compressor motor and the defrost heater, in which the time of energization of the compressor motor and the defrost heater, respectively, is accumulated, the time of the compressor motor energization and the time of defrost heater energization being varied based on the quantity of accumulated time of the compressor motor in a previous cycle, a method comprising the steps of connecting an attenuated half wave signal of the AC line voltage to the IRQ port of the microprocessor, determining whether the defrost heater or the compressor motor is energized and, when either the defrost heater or the compressor motor is energized, counting a selected number of interrupts caused by the negative edge of the attenuated half wave of the AC voltage, the selected number of interrupts comprising a time unit and counting the accumulation of time units.

14. An adaptive defrost system according to claim 13 in which the line voltage is 60 Hz and the selected number of interrupts is 1800 thereby providing a time unit of 30 seconds.

15. An adaptive defrost system for refrigeration apparatus having a compressor motor, a defrost heater, a microprocessor for controlling energization and de-energization of the compressor motor and defrost heater respectively, a method of discriminating noise from signals comprising the steps of taking an attenuated AC line signal and detecting the presence of a logic level high input voltage, once the input voltage level goes high, sampling the input voltage for a selected length of time, an input voltage remaining logic level high for less than the selected length of time being considered noise.

16. A method according to claim 15 in which the AC line is 60 Hz and the selected length of time is 3.3 in milliseconds.

17. An adaptive defrost system for refrigeration apparatus having a compressor motor and a defrost heater, the compressor motor having a start winding, comprising a microprocessor and a first set of relay contacts in a first line connected to line voltage and being serially connected to the compressor motor and being movable between first and second positions and a second set of relay contacts in a second line connected to line voltage and being serially connected to the defrost heater and being movable between first and second positions, and a third set of relay contacts connected to the start winding, and being movable between first and second positions, coil means coupled to the microprocessor for actuating the first, second and third sets of relay contacts, a power supply for supplying a first low level of power for the microprocessor and a second high level of power for actuating the first, second and third sets of relay contacts, feedback signal means connected to the first and second lines and to the microprocessor so that the microprocessor can monitor the energization of the compressor motor and the defrost heater and means to vary the accumulated operating time of the compressor motor based on the feedback signal.

* * * * *